US007697702B2

(12) United States Patent
Akino

(10) Patent No.: US 7,697,702 B2
(45) Date of Patent: Apr. 13, 2010

(54) CONDENSER MICROPHONE

(75) Inventor: Hiroshi Akino, Machida (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 1061 days.

(21) Appl. No.: 11/248,327

(22) Filed: Oct. 13, 2005

(65) Prior Publication Data

US 2006/0083392 A1 Apr. 20, 2006

(30) Foreign Application Priority Data

Oct. 20, 2004 (JP) ..... 2004-305511

(51) Int. Cl.
*H04R 3/00* (2006.01)
*H04R 1/00* (2006.01)
*H04R 3/02* (2006.01)
*H04R 25/00* (2006.01)

(52) U.S. Cl. ..... 381/111; 381/91; 381/113; 381/122; 381/172

(58) Field of Classification Search ..... 381/111, 381/113, 122, 172, 375
See application file for complete search history.

(56) References Cited

U.S. PATENT DOCUMENTS 7,046,815 B2 * 5/2006 Akino et al. ..... 381/122
7,295,675 B2 * 11/2007 Akino et al. ..... 381/113
2006/0083392 A1 * 4/2006 Akino ..... 381/122

FOREIGN PATENT DOCUMENTS

JP 06-052300 * 7/1994

* cited by examiner

*Primary Examiner*—Brian Ensey
*Assistant Examiner*—Sunita Joshi
(74) *Attorney, Agent, or Firm*—Manabu Kanesaka

(57) ABSTRACT

The present invention provides a condenser microphone having a proximity sensor consisting of an infrared light emitting diode and an infrared photodetector, the condenser microphone preventing the occurrence of noise and the malfunctioning of the infrared photodetector when the infrared light emitting diode is lighted using an AC component. Specifically, the present invention provides a condenser microphone operated using a predetermined DC power source; an infrared light emitting diode 20 is lighted at a predetermined frequency by an oscillation circuit 22 using an AC component, and a microphone output is turned on and off by an output signal from the infrared photodetector 21 which is tuned to the predetermined frequency. The condenser microphone further includes two DC-DC converters 23 and 24 connected in parallel with the DC power source. One 23 of the DC-DC converters 23 supplies power to the infrared light emitting diode 20 and the oscillation circuit 22. The other DC-DC converter 24 supplies power to the infrared photodetector 21.

2 Claims, 1 Drawing Sheet

CONDENSER MICROPHONE

TECHNICAL FIELD

The present invention relates to a condenser microphone, and more specifically, to a condenser microphone comprising a proximity sensor consisting of an infrared light emitting diode and an infrared photodetector.

BACKGROUND ART

Condenser microphones have various applications. For example, some condenser microphones are installed on a speech table in a conference room or a church. These condenser microphones comprise a proximity sensor that turns on a microphone output only when there is a speaker standing in front of the speech table; the proximity sensor turns off the microphone output when there is no speaker standing in front of the speech table.

Proximity sensors are classified into a supersonic type, an electrostatic type, an infrared type, and the like. For microphones, the infrared proximity sensor is generally used, which consists of an infrared light emitting diode not serving as a noise source and an infrared photodetector.

However, the infrared proximity sensor may malfunction when the speaker is at a standstill or owing to external light, a variation in temperature, or the like. Thus, to improve the reliability of the proximity sensor, an oscillation circuit is used to light an infrared light emitting diode at a predetermined frequency using an AC component. Further, an infrared photodetector tuned to this frequency is used in combination with the infrared light emitting diode.

In this case, an infrared beam is radiated to the speaker. Then, the infrared beam reflected by the speaker is received. Accordingly, the infrared light emitting diode needs to have a high radiant intensity. The infrared photodetector needs to have a high sensitivity. To increase the radiant intensity of the infrared light emitting diode, a forward current passed through the diode must be increased. For example, for infrared light emitting diodes TLN119 manufactured by TOSHIBA CORPORATION, a current of about 10 mA is required.

In this regard, a phantom power source generally used for condenser microphones provides an excessively high voltage. Accordingly, a down converter must be used to reduce the voltage to increase the current. The down converter is based on one of various methods; a pulse width modulation type is often used.

However, the pulse width modulation down converter interrupts an input voltage. Consequently, the pulse width modulation down converter makes noise of a very high level in connection with the switching. The noise may be mixed into the power supply voltage to increase the amount of noise from the microphone.

Further, the down converter is provided with an inductor. Accordingly, a noisy current flowing through the inductor results in an external magnetic field, which may be magnetically coupled to an output transformer in the microphone. As a result, noise may be output.

On the other hand, only a very small amount of infrared beam is reflected by the speaker. Accordingly, a very sensitive infrared photodetector is used. However, when the AC component used to light the infrared light emitting diode is superimposed on the power supply to the infrared photodetector, the infrared photodetector malfunctions as if it received an infrared beam, because of its high sensitivity.

SUMMARY OF THE INVENTION

It is thus an object of the present invention to provide a condenser microphone having a proximity sensor consisting of an infrared light emitting diode and an infrared photodetector, the condenser microphone preventing the occurrence of noise and the malfunctioning of the infrared photodetector when the infrared light emitting diode is lighted using an AC component.

To achieve this object, the present invention provides a condenser microphone operated using a predetermined DC power source and comprising a proximity sensor including an infrared light emitting diode and an infrared photodetector, the infrared light emitting diode being lighted at a predetermined frequency by an oscillation circuit using an AC component, a microphone output being turned on and off by an output signal from the infrared photodetector which is tuned to the predetermined frequency, the condenser microphone being characterized by further comprising two DC-DC converters connected in parallel with the DC power source, one of the DC-DC converters supplying power to the infrared light emitting diode and the oscillation circuit, the other DC-DC converter supplying power to the infrared photodetector.

In this arrangement, a power supply line for the infrared light emitting diode is separated from a power supply line for the infrared photodetector in connection with the AC component. This prevents the infrared photodetector from malfunctioning as a result of the AC component used to light the infrared light emitting diode using an AC component.

More preferably, a lighting frequency of the infrared light emitting diode is different from an operating frequency of the DC-DC converters.

In this arrangement, the lighting frequency of the infrared light emitting diode is different from the operating frequency of the DC-DC converters. This prevents these frequencies from interfering with each other to generate noise of an audible frequency.

Moreover, a switched capacitor type voltage converter is preferably used as the DC-DC converter.

The switched capacitor type voltage converter is composed of a semiconductor switch, a switching oscillator for the semiconductor switch, and an external condenser in which charges are accumulated. The switched capacitor type voltage converter, for example, doubles an input voltage or reduces it to half simply by charging or discharging the condenser. This prevents noise from being mixed into the power supply voltage of the condenser microphone. It is also possible to allow the DC power source (in many cases, a phantom power source) for the condenser microphone to supply a sufficient driving current to the infrared light emitting diode.

DETAILED DESCRIPTION

Figure 1:
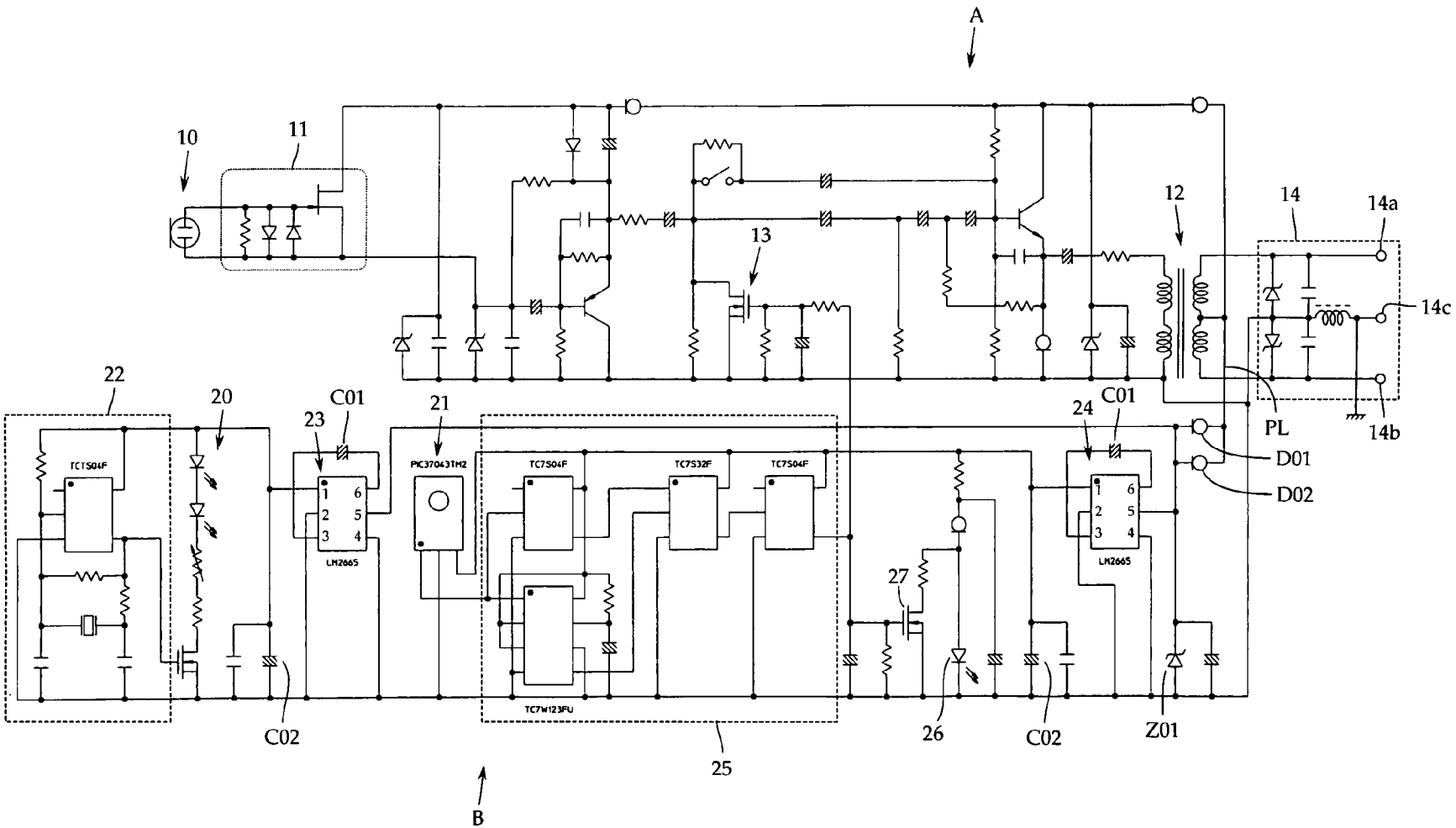
FIG. 1 is a circuit diagram showing an example of configuration of a condenser microphone in accordance with the present invention.

Now, an embodiment of the present invention will be described with reference to FIG. 1. However, the present invention is not limited to this. FIG. 1 is a detailed circuit diagram of a condenser microphone. Here, description will focus on a power source section of an infrared proximity sensor which relates to the present invention.

FIG. 1 shows a sound signal output circuit A in a microphone having a condenser microphone unit 10, and a proximity sensor circuit B having an infrared light emitting diode 20 and an infrared photodetector 21. The proximity sensor circuit B is provided with an oscillation circuit 22 that lights the infrared light emitting diode 20 using an AC component. The infrared photodetector 21 is turned to its lighting frequency to output a sensing signal.

The condenser microphone unit 10 may be, for example, a gooseneck microphone or a stand type microphone and may be installed in a predetermined place. The proximity sensor may be provided in a housing of the microphone, a microphone stand, or the like provided that it can sense a speaker at this position.

In the sound signal output circuit A in the microphone, the condenser microphone unit 10 is connected to an impedance converter 11 including a FET (Field Effect Transistor). The impedance converter 11 is connected to a primary winding side of an output transformer 12 via an amplifying circuit. A microphone output switch 13 is provided between the impedance converter 11 and the output transformer 12; the microphone output switch 13 is controllably turned on and off by an output from the infrared photodetector 21 in the proximity sensor. In this example, the microphone output switch 13 consists of a FET switch.

An output connector 14 is connected to a secondary winding side of the output transformer 12. The output connector 14 is of a 3-pin type specified in, for example, EIAJ RC5236. The output connector 14 comprises a hot terminal 14*a* and a cold terminal 14*b* connected to a phantom power source (not shown), and a ground terminal 14*c*.

That is, the hot terminal 14*a* and the cold terminal 14*b* are connected to the respective ends of the secondary winding of the output transformer 12. A feeding line PL for the sound signal output circuit A and proximity sensor circuit B is drawn out from the middle point of the secondary winding. The ground terminal 14*c* is connected to a ground line for the sound signal output circuit A and proximity sensor circuit B. In this example, the output connector 14 is provided with a high frequency protective circuit consisting of a combination of a choke coil, a condenser, and a Zener diode.

In the present invention, the proximity sensor circuit B is provided with a first DC-DC converter 23 that supplies power to the infrared light emitting diode 20 and its oscillation circuit 22, and a second DC-DC converter 24 that supplies power to the infrared photodetector 21.

The first and second DC-DC converters 23 and 24 are connected in parallel with the feeding line PL from the phantom power source via constant current diodes D01 and D02; the feeding line PL is drawn out from the middle point of the secondary winding of the output transformer 12. This separates the power supply line for the infrared light emitting diode 20 from the power supply line for the infrared photodetector 21 in connection with the AC component.

In the present invention, each of the DC-DC converters (sometimes referred to simply as "converters" below) 23 and 24 is preferably a switched capcaitor type voltage converter that does not incur switching noise. In this example, LM2665 manufactured by NATIONAL SEMICONDUCTOR in U.S. is used as the DC-DC converter.

The LM2665 converter has six pins. A charge pump condenser C01 is externally connected to between a third and sixth pins. When a positive voltage is input from a first pin, the converter operates as a double booster type to output a double voltage from a fifth pin. Conversely, when a positive voltage is input from the fifth pin, the converter operates as a half voltage drop type to output a half voltage from the first pin.

In this example, the converter is used as the half voltage drop type. Accordingly, for both converters 23 and 24, a positive voltage is input from the fifth pin, whereas a half output voltage is obtained from the first pin. A second pin is a ground pin and a fourth pin is a shutdown control pin. The outputting first pin connects to a condenser C02 for smoothing and AC grounding.

For example, when the phantom power source supplies a voltage of 30 V and a current of 2.7 mA to the circuit via the constant current diodes D01 and D02, the total current is 5.4 mA. An input Zener diode Z01 limits the input voltage to each of the converters 23 and 24 to 10 V. Thus, a voltage of about 5 V and a current of about 10 mA are obtained from the first pin and used as a power supply to drive the infrared light emitting diode 20, the oscillation circuit 22, and the infrared photodiode 21.

Thus, when the Zener diode Z01 controls the input voltage to each of the converters 23 and 24, for example, the phantom power source can provide a current sufficient to light the infrared light emitting diode 20 at a high radiant intensity.

Further, since the LM2665 converter has a switching frequency of 80 kHz, in this example, the oscillation frequency of the oscillation circuit 22 is set at 38 kHz to prevent the occurrence of noise of an audible frequency as a result of interference.

It is assumed that there is a speaker standing in front of the microphone. Then, when, for example, the infrared light emitting diode 20 is lighted at a frequency of 38 kHz using the AC component and the infrared photodetector 21 receives a reflected beam from the speaker, as described above, the infrared photodetector 21 outputs a sensing signal.

The sensing signal is provided to a microphone output switch 13 via a hold circuit 25. This turns on a microphone output. If there is no speaker standing in front of the microphone, the infrared photodetector 21 does not output any sensing signal. Consequently, the microphone output is turned off. In this example, the hold circuit 25 is composed of a general-purpose logic IC. However, the hold circuit 25 may be configured differently provided that it can hold a sensing signal output by the infrared photodetector 21 for a predetermined time.

Further, in this example, an operation displaying light emitting diode 26 is provided which is lighted while the microphone output is on. The operation displaying light emitting diode 26 is connected between a power supply line and a ground line in a driving system for the infrared photodetector 21. A bypass circuit including an FET switch 27 is connected in parallel with the operation displaying light emitting diode 26.

A gate of the FET switch 27 is connected to the hold circuit 25. If there is any sensing signal, the FET switch 27 is turned off to light the operation displaying light emitting diode 26. If there is no sensing signal, the FET switch 27 is turned on to extinguish the operation displaying light emitting diode 26. This enables the speaker to determine whether the microphone output is on or off.

The present application is based on, and claims priority from, Japanese Application Serial Number JP2004-305511, filed Oct. 20, 2004, the disclosure of which is hereby incorporated by reference herein in its entirety.

The invention claimed is:

1. A condenser microphone comprising:

a phantom power source as a predetermined DC power source, a proximity sensor including an infrared light emitting diode and an infrared photodetector, the infrared light emitting diode being lighted at a predetermined frequency by an oscillation circuit using an AC component, a microphone output turned on and off by an output signal from the infrared photodetector which is tuned to a predetermined frequency, and two DC-DC converters connected in parallel with the DC power source, one of the DC-DC converters supplying power to the infrared light emitting diode and the oscillation circuit, and the other DC-DC converter supplying power to the infrared photodetector wherein said two DC-DC converters are switched capacitor voltage converters as a half voltage drop type and are connected in parallel with feeding line from the phantom power source via constant current diodes, to separate the power supply lines.

2. The condenser microphone according to claim 1, wherein a lighting frequency of the infrared light emitting diode is different from an operating frequency of the DC-DC converters.

* * * * *